US012305900B2

(12) United States Patent
Bashyam

(10) Patent No.: US 12,305,900 B2
(45) Date of Patent: May 20, 2025

(54) INTELLIGENT CHARGE COMPENSATION IN A HEAT PUMP SYSTEM

(71) Applicant: Allied Air Enterprises LLC, West Columbia, SC (US)

(72) Inventor: Krishna Conjeevaram Bashyam, Lexington, SC (US)

(73) Assignee: Allied Air Enterprises LLC, West Columbia, SC (US)

( * ) Notice: Subject to any disclaimer, the term of this patent is extended or adjusted under 35 U.S.C. 154(b) by 272 days.

(21) Appl. No.: 18/063,973

(22) Filed: Dec. 9, 2022

(65) Prior Publication Data

US 2024/0191922 A1 Jun. 13, 2024

(51) Int. Cl.

| | |
|---|---|
| ***F25B 45/00*** | (2006.01) |
| ***F25B 13/00*** | (2006.01) |
| ***F25B 49/02*** | (2006.01) |

(52) U.S. Cl.

CPC ..... *F25B 45/00* (2013.01); *F25B 13/00* (2013.01); *F25B 49/02* (2013.01); *F25B 2345/003* (2013.01); *F25B 2500/23* (2013.01); *F25B 2500/24* (2013.01); *F25B 2600/2519* (2013.01)

(58) Field of Classification Search

CPC ..... F25B 45/00; F25B 13/00; F25B 41/20; F25B 49/02; F25B 2345/003; F25B 2500/23; F25B 2500/24; F25B 2600/2519

See application file for complete search history.

(56) References Cited

U.S. PATENT DOCUMENTS

| | | | | |
|---|---|---|---|---|
| 4,045,977 | A * | 9/1977 | Oliver, Jr. | F25B 13/00 62/324.4 |
| 5,136,855 | A * | 8/1992 | Lenarduzzi | F25B 43/006 62/503 |
| 5,937,670 | A * | 8/1999 | Derryberry | F25B 41/20 62/174 |
| 2019/0390881 | A1* | 12/2019 | Bachellor | F25B 41/20 |
| 2024/0191917 | A1* | 6/2024 | Bashyam | F25B 45/00 |
| 2024/0191923 | A1* | 6/2024 | Bashyam | F25B 41/24 |

OTHER PUBLICATIONS

U.S. Appl. No. 18/063,880, entitled, "Heat Pump Charge Compensation for Heating Mode Operation," filed Dec. 9, 2022.
U.S. Appl. No. 18/063,943, entitled, "Heat Pump Charge Compensation for Cooling Mode Operation," filed Dec. 9, 2022.

* cited by examiner

*Primary Examiner* — Marc E Norman
(74) *Attorney, Agent, or Firm* — Baker Botts L.L.P.

(57) ABSTRACT

An HVAC system includes a first heat exchange coil with a plurality of coil circuits. For each coil circuit of the plurality of circuits, there is a manifold line fluidly coupling the coil circuit to a compressor. A first controllable valve is positioned in a first manifold line coupling a first coil circuit of the plurality of coil circuits to the compressor. A second controllable valve is located in a conduit fluidly coupling the first coil circuit to a second heat exchange coil. A controller is communicatively coupled to the first and second controllable valves and operates the valves to provide charge compensation in a heating and/or cooling mode.

20 Claims, 8 Drawing Sheets

INTELLIGENT CHARGE COMPENSATION IN A HEAT PUMP SYSTEM

TECHNICAL FIELD

This disclosure relates generally to heating, ventilation, and air conditioning (HVAC) systems. More particularly, in certain embodiments, this disclosure relates to intelligent charge compensation in a heat pump system.

BACKGROUND

Heating, ventilation, and air conditioning (HVAC) systems are used to regulate environmental conditions within an enclosed space. Air is cooled via heat transfer with refrigerant flowing through the HVAC system and returned to the enclosed space as conditioned air. In a heat pump HVAC system, the flow of refrigerant can be reversed to provide heating to a space.

SUMMARY OF THE DISCLOSURE

In some cases, there may be an imbalance between the amount of refrigerant needed to achieve desired heating and cooling using a heat pump system. This issue, in which the amount of refrigerant charged to the system is optimized to one mode of operation and performance or efficiency may suffer in another mode, is referred to as charge imbalance. For instance, a heat pump system may be charged to operate optimally in cooling mode, while efficiency and/or performance is decreased in heating mode. Previous technologies to deal with charge imbalance involve the use of separate charge compensator devices and corresponding plumbing to store excess refrigerant when not needed in a given operating mode. Such charge compensation devices may be costly and complex to install, and such devices may be impractical for certain systems.

This disclosure solves problems of previous heat pump systems by facilitating improved charge compensation without added plumbing and charge compensation devices. For example, rather than requiring expensive and bulky charge compensation equipment, one or more valves may be added and appropriately operated such that the flow of refrigerant through or collection of refrigerant within one or more coil circuits of a heat exchange coil can provide improved charge compensation. In this way, efficient performance can be achieved in both heating and cooling modes. Certain embodiments may include none, some, or all of the above technical advantages. One or more other technical advantages may be readily apparent to one skilled in the art from the figures, descriptions, and claims included herein.

In an embodiment, an HVAC system includes a first heat exchange coil with a plurality of coil circuits. For each coil circuit of the plurality of circuits, there is a manifold line fluidly coupling the coil circuit to a compressor of the HVAC system. A check valve is positioned in a first manifold line coupling a first coil circuit of the plurality of coil circuits to the compressor. The check valve is configured to allow flow of refrigerant from the compressor to the first coil circuit when the HVAC system is operating in a cooling mode and prevent flow of refrigerant from the first coil circuit to the compressor when the HVAC system is operating in a heating mode.

In another embodiment, an HVAC system includes a first heat exchange coil with a plurality of coil circuits, a second heat exchange coil, and an expansion valve. For each coil circuit of the plurality of circuits, there is a conduit coupling the coil circuit to the expansion valve. A check valve is positioned in a first conduit coupling a first coil circuit of the plurality of coil circuits to the expansion valve. The check valve is configured to prevent flow of refrigerant from the first coil circuit to the expansion valve when the HVAC system is operating in a cooling mode.

In yet another embodiment, an HVAC system includes a first heat exchange coil with a plurality of coil circuits. For each coil circuit of the plurality of circuits, there is a manifold line fluidly coupling the coil circuit to a compressor. A first controllable valve is positioned in a first manifold line coupling a first coil circuit of the plurality of coil circuits to the compressor. A second controllable valve is located in a conduit fluidly coupling the first coil circuit to a second heat exchange coil. A controller is communicatively coupled to the first and second controllable valves The controller is configured to determine that the HVAC system is operating in a cooling mode and determine that charge compensation is needed. After determining that the HVAC system is operating in the cooling mode and that charge compensation is needed, the controller causes the first controllable valve to be in an open position for at least a period of time and causes the second controllable valve to be in a closed position, such that flow of refrigerant from the first coil circuit to the second heat exchange coil is prevented.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1-8 of the drawings, like numerals being used for like and corresponding parts of the various drawings.

Figure 1:
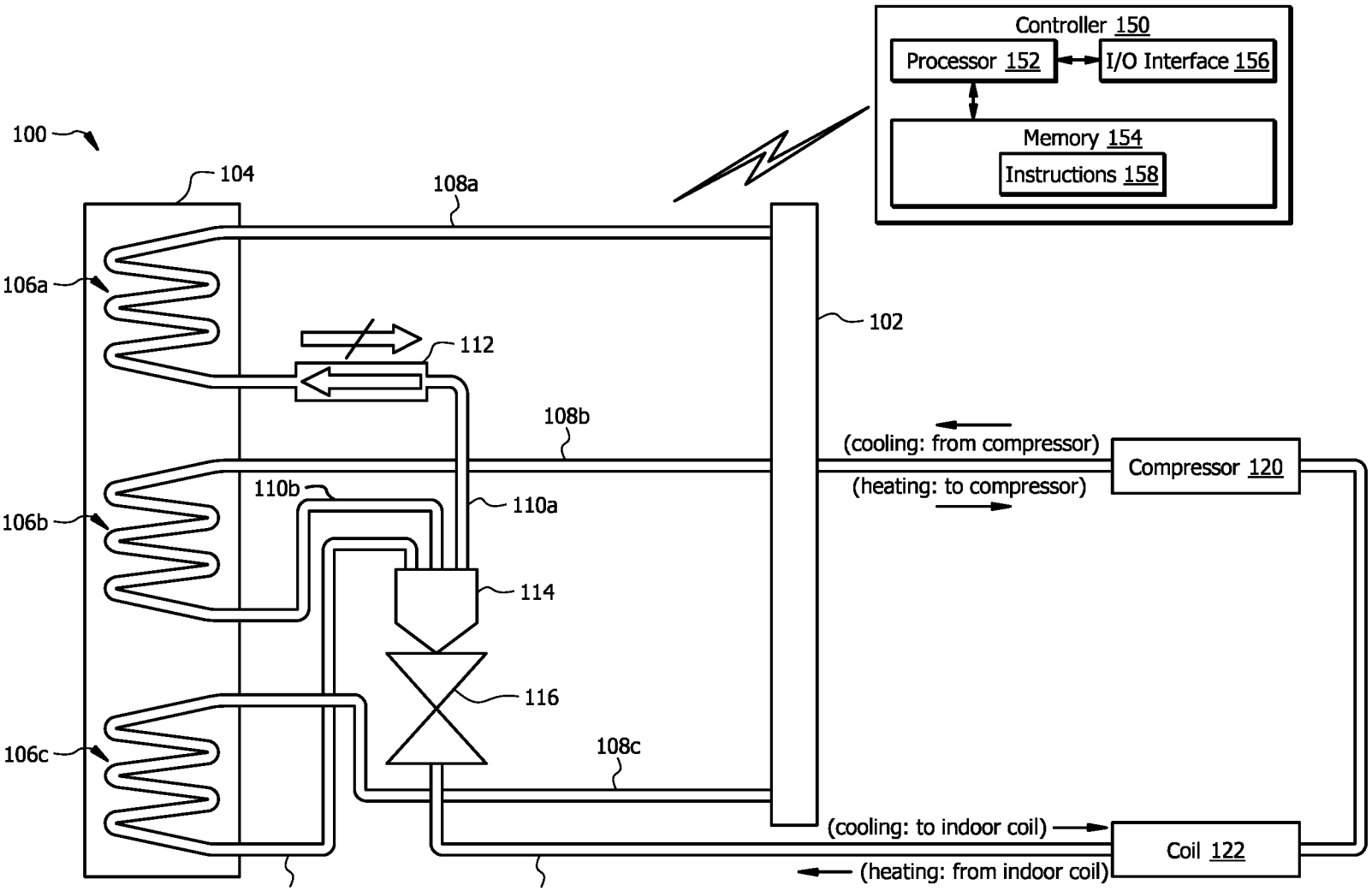
FIG. 1 is a diagram of an example heat pump system configured for improved operation during cooling mode operation.
Figure 2:
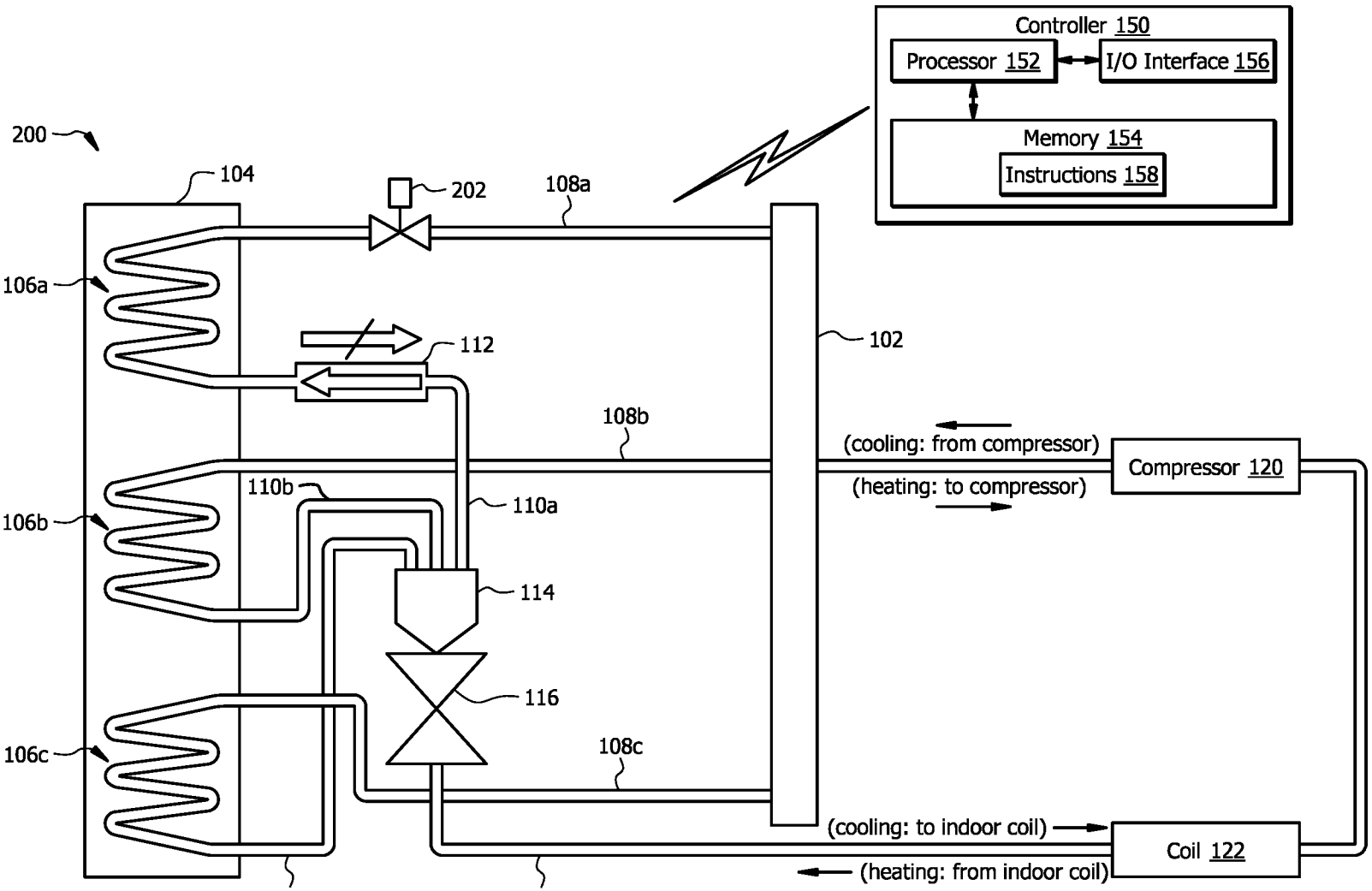
FIG. 2 is a diagram of another example heat pump system configured for improved operation during cooling mode operation.
Figure 3:
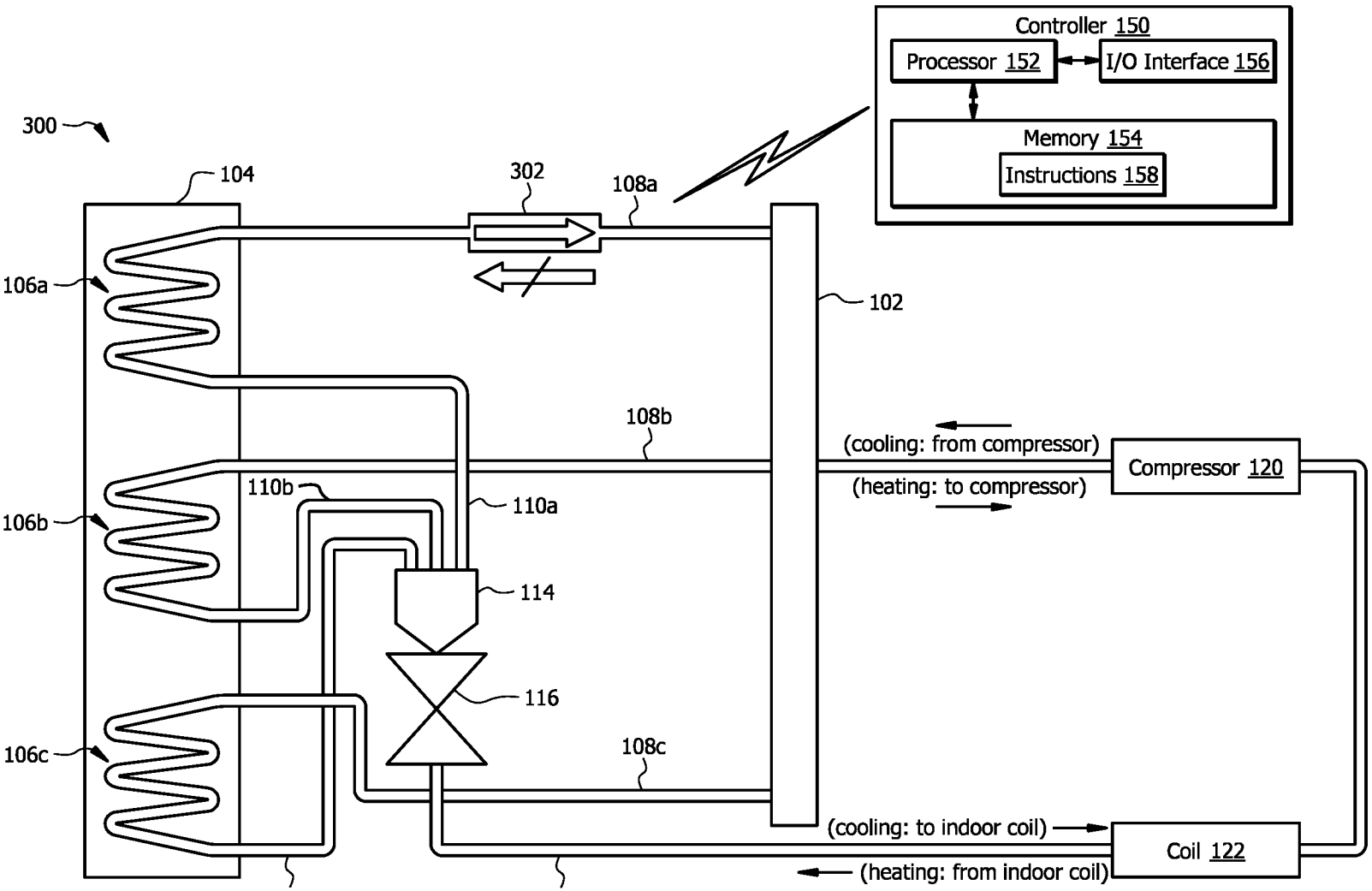
FIG. 3 is a diagram of another example heat pump system configured for improved operation during cooling mode operation.
Figure 4:
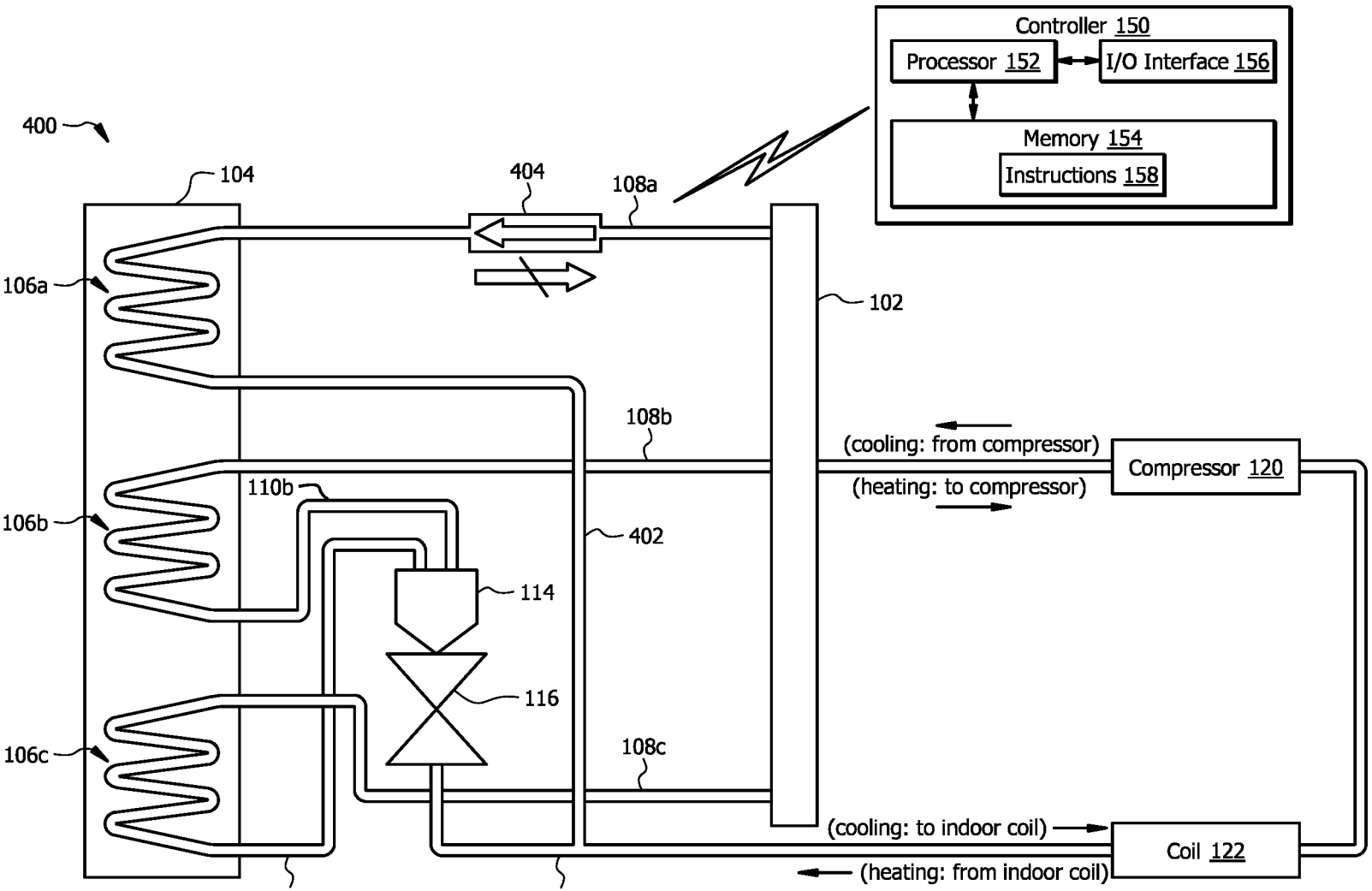
FIG. 4 is a diagram of an example heat pump system configured for improved operation during heating mode operation.
Figure 5:
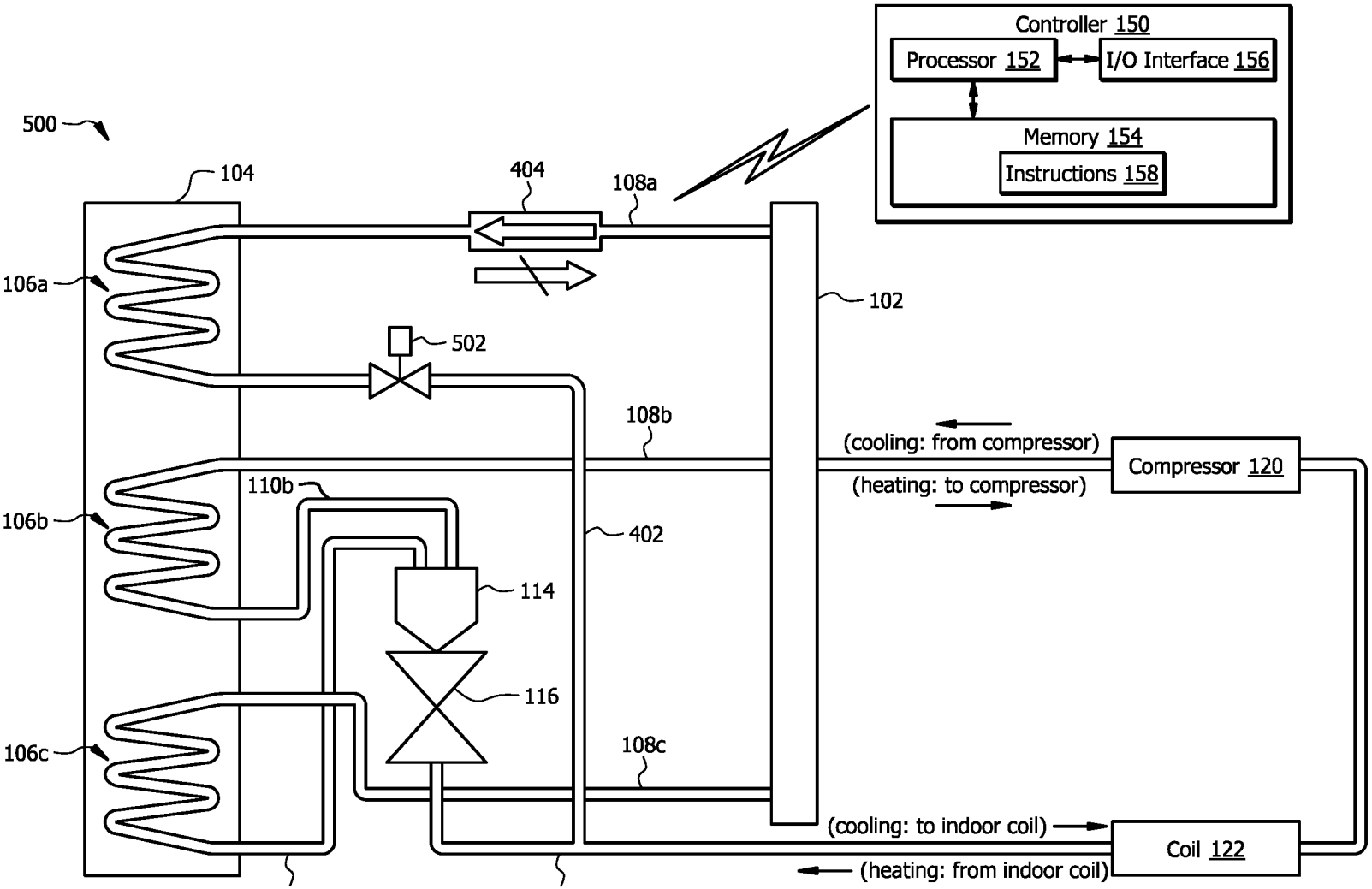
FIG. 5 is a diagram of another example heat pump system configured for improved operation during heating mode operation.
Figure 6:
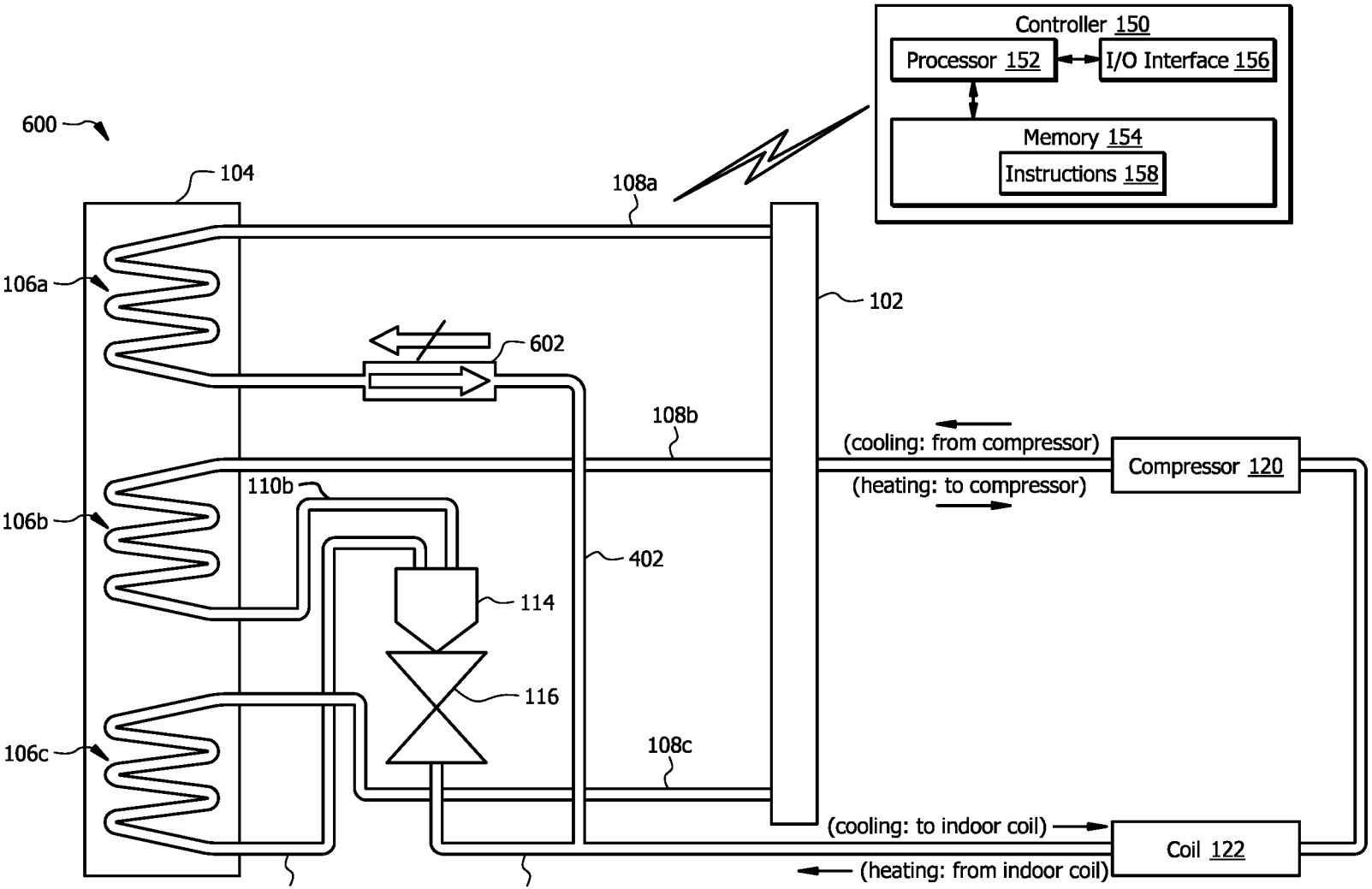
FIG. 6 is a diagram of another example heat pump system configured for improved operation during heating mode operation.

As described above, prior to the present disclosure, there was a need for improved tools for providing reliable and efficient charge compensation. FIGS. 1-7 show improved heat pump-type HVAC systems that include check valves and/or flow control valves that can adjust the flow of refrigerant, for example, to facilitate improved performance and/or efficiency in heating and/or cooling modes. For example, the systems of FIGS. 1-3 provide improved cooling-mode charge compensation by storing refrigerant during cooling mode operation and/or reducing the number of active coil circuits used in a heat exchanger during cooling mode operation. The systems of FIGS. 4-6 provide improved heating-mode charge compensation by storing refrigerant during heating mode operation and/or reducing the number of active coil circuits used in a heat exchanger during heating mode operation. The system of FIG. 7 facilitates variable charge storage in heating and/or cooling mode operation. While the examples below describe control of refrigerant flow to a single circuit of a heat exchange coil, the approach may be used to control refrigerant flow to multiple circuits and/or multiple coils.

HVAC/Heat Pump System for Cooling Mode Charge Compensation

FIGS. 1-3 show example heat pump HVAC systems 100, 200, and 300 configured to provide improved operation via charge compensation in a cooling mode. The systems 100, 200, and 300 condition air for delivery to a conditioned space (e.g., all or a portion of a room, a house, an office building, a warehouse, or the like). In some embodiments, the systems 100, 200, and 300 are rooftop units (RTUs) that are positioned on the roof of a building, and the conditioned air is delivered to the interior of the building. In other embodiments, portion(s) of the systems 100, 200, and 300 may be located within the building and portion(s) outside the building. The systems 100, 200, and 300 may be configured as shown in FIGS. 1-3 or in any other suitable configuration. For example, the systems 100, 200, and 300 may include additional components or may omit one or more components.

The systems 100, 200, and 300 include a compressor manifold 102, a first heat exchange coil 104, a distributor 114, an expansion valve 116, a compressor 120, and a second heat exchange coil 122. The systems 100, 200, and 300 are configured to operate in a cooling mode and a heating mode. In the cooling mode, refrigerant flows from compressor 120 to manifold 102 and then to the first heat exchange coil 104 where the refrigerant is cooled. The cooled refrigerant then passes through expansion valve 116 and through the second heat exchange coil 122 where the cool, expanded refrigerant is used to cool air that is provided to the space. Refrigerant is heated in the second heat exchange coil 122 and returns to the compressor 120. In the heating mode, refrigerant flows in the reverse direction of the cooling mode. In the heating mode, refrigerant flows from compressor 120 to the second heat exchange coil 122. The heated compressed refrigerant that enters the second heat exchange coil 122 heats air that is provided to heat the space. The refrigerant is cooled in the second heat exchange coil 122 via this heat exchange, and the cooled refrigerant passes through the expansion valve 116 and through the first heat exchange coil 104. The cooled, expanded refrigerant is heated in the first heat exchange coil 104, and the resulting heated refrigerant is provided back to the compressor 120.

The systems 100, 200, and 300 include fluid conduit including manifold lines 108*a-c*, distribution lines 110*a-c*, and liquid line 118, that facilitate the movement of refrigerant through the cooling and heating cycles described above. The refrigerant may be any acceptable working fluid including, but not limited to hydrofluorocarbons (e.g., R-410A) or any other suitable type of refrigerant.

The first heat exchange coil 104 transfers heat between refrigerant passing therethrough and a flow of air passing over the coil 104. The first heat exchange coil 104 may be an outdoor heat exchange coil. The first heat exchange coil 104 includes multiple coil circuits to which refrigerant is provided to facilitate heat exchange. When the systems 100, 200, 300 are operating in a cooling mode, the first heat exchange coil 104 acts as a condenser and removes heat from refrigerant received from the compressor 120. When the systems 100, 200, 300 are operating in a heating mode, the first heat exchange coil 104 acts as an evaporator and transfers heat to refrigerant received from the second heat exchange coil 122. A fan (not shown for conciseness) may move air across the first heat exchange coil 104.

In the example system 100 of FIG. 1, a check valve 112 is positioned in the first distribution line 110*a* of the first circuit 106*a* of the first heat exchange coil 104. The check valve 112 prevents flow of refrigerant from the first circuit 106*a* to the expansion valve 116 and allows flow of refrigerant from the expansion valve 116 (or distributor 114) to the first circuit 106*a*. When the system 100 is operating in a cooling mode, refrigerant flow is prevented from the first circuit 106*a* to the expansion valve 116. This causes refrigerant to be stored in the first circuit 106*a* during cooling mode operation and to not contribute to the cooling cycle. During heating mode operation, the first circuit 106*a* receives refrigerant and facilitates heat transfer. The configuration of system 100 with check valve 112 may be beneficial in circumstances in which the system 100 needs a higher heating capacity than cooling capacity (e.g., in cool climates). By storing refrigerant in the first circuit 106*a*, a decreased cooling demand may be met more efficiently without requiring complex and costly charge compensation devices.

In the example system 200 of FIG. 2, the system 200 includes the check valve 112 positioned in distribution line 110*a* (see FIG. 1) as well as a controllable valve 202 positioned in the manifold line 108*a* connecting the first circuit 106*a* to the manifold 102. Check valve 112 operates as described above with respect to the system 100 of FIG. 1 by preventing flow of refrigerant from the first circuit 106*a* to the expansion valve 116 and allowing flow in the opposite direction. The first circuit 106*a* again stores refrigerant during cooling mode operation. The controllable valve 202 can be used to adjust the amount of refrigerant stored in the first circuit 106*a* during cooling mode operation. For example, the controllable valve 202 may close after a predetermined period of time of operating in the cooling mode and/or after a predetermined volume of refrigerant is stored in the first circuit 106*a*. The configuration of system 200 with both the check valve 112 and controllable valve 202 provides further control over the amount of refrigerant stored in the first circuit 106*a* during cooling mode operation. System 200 may be used, for example, when the second heat exchange coil 122 is larger (or has a larger capacity) than the first heat exchange coil 104. This configuration may provide improved operation in the cooling mode without complex and costly charge compensation devices.

The controller 150 is communicatively coupled (e.g., via wired and/or wireless connection) to components of system 400. The controller 150 generally controls operations of the compressor 120 and the controllable valve 202. For example, instructions 158 stored in a memory 154 of the controller 150 may cause the controllable valve 202 to close and open, as described above. The processor 152 may include other hardware and software that operates to process information, control the system 400 and perform any of the functions described herein. The memory 154 is operable to store any suitable set of instructions 158, logic, rules, and/or code for executing the functions described in this disclosure. The I/O interface 156 may send signals that adjust an open/closed state of controllable valve 202.

In the example system 300 of FIG. 3, a check valve 302 is positioned in the manifold line 108*a* coupling the first circuit 106*a* to the manifold 102 (or to the compressor 120). The check valve 302 prevents flow of refrigerant from the manifold 102 (or to the compressor 120) to the first circuit 106*a* and allows refrigerant flow in the opposite direction from the first circuit 106*a* to the manifold 102 (or to the compressor 120). In this way, the check valve 302 prevents refrigerant from flowing through the first circuit 106*a* during cooling mode operation. This configuration effectively decreases the number of circuits 106*a-c* that are used during cooling mode operation. The configuration of system 300 may be used in circumstances of relative coil size and/or environmental conditions where less cooling capacity than heating capacity is needed.

Referring again to the shared components of system 100, 200, and 300 of FIGS. 1-3, the first heat exchange coil 104 includes a number of coil circuits 106*a-c*. Each coil circuit 106*a-c* has a corresponding manifold line 108*a-c* that fluidically couples the circuit 106*a-c* to the compressor manifold 102 and a corresponding distribution line 110*a-c* that fluidically couples the circuit 106*a-c* to the distributor 114. The distributor 114 is a device that facilitates fluidic coupling between the expansion valve 116 and the distribution lines 110*a-c*. During heating mode operation, the expansion valve 116 decreases the pressure of refrigerant that flows therethrough. In this way, refrigerant is delivered to the first heat exchange coil 104 at a decreased pressure during heating mode operation. During cooling mode operation, the refrigerant from the first heat exchange coil 104 may pass through an internal bypass inside the expansion valve 116. In some embodiments, there may be no appreciable pressure loss within the expansion valve 116 during the cooling mode operation. As an example, the expansion valve 116 may be a thermostatic expansion valve (TXV) or any other suitable valve for decreasing the pressure of the refrigerant. A liquid line 118 fluidly couples the expansion valve 116 to the second heat exchange coil 122.

The compressor 120 may be a constant speed, a two speed or variable speed compressor. The compressor 120 may be a single compressor or may include two or more compressors (e.g., that may be operated in stages). The compressor 120 is coupled to the compressor manifold 102, which includes any appropriate conduit for connecting the compressor 120 to the manifold lines 108*a-c*. The compressor 120 generally compresses (i.e., increases the pressure of) the refrigerant, as described with respect to the example cooling and heating cycles above. The compressor 120 is in signal communication with the controller 150 using wired and/or wireless connection. The controller 150 provides commands and/or signals to control operation of the compressor 120 and/or receive signals from the compressor 120 corresponding to a status of the compressor 120.

The second heat exchange coil 122 transfers heat between refrigerant passing therethrough and a flow of air passing over the coil 122. The second heat exchange coil 122 may be an indoor heat exchange coil. The second heat exchange coil 122 has one or more circuits, similar or the same as those shown for the first heat exchange coil 104. When the systems 100, 200, 300 are operating in a cooling mode, the second heat exchange coil 122 acts as an evaporator and transfers heat to refrigerant received from the expansion valve 116. When the systems 100, 200, 300 are operating in a heating mode, the second heat exchange coil 122 acts as a condenser and removes heat from refrigerant received from the compressor 120. A fan or blower (not shown for conciseness) may move air across the second heat exchange coil 122. This air may be provided as conditioned air to cool or heat the space serviced by the systems 100, 200, 300.

The controller 150 is communicatively coupled (e.g., via wired and/or wireless connection) to components of the systems 100, 200, and 300 and configured to control their operation. The controller 150 generally controls operations of the compressor 120 and controllable valve 202. For example, instructions 158 stored in a memory 154 of the controller 150 may cause the controllable valve 202 to close and open, as described above.

The controller 150 includes a processor 152, memory 154, and input/output (I/O) interface 156. The processor 152 comprises one or more processors operably coupled to the memory 154. The processor 152 is any electronic circuitry including, but not limited to, state machines, one or more central processing unit (CPU) chips, logic units, cores (e.g., a multi-core processor), field-programmable gate array (FPGAs), application specific integrated circuits (ASICs), or digital signal processors (DSPs) that communicatively couples to memory 154 and controls the operation of systems 100, 200, and 300. The processor 152 may be a programmable logic device, a microcontroller, a microprocessor, or any suitable combination of the preceding. The processor 152 is communicatively coupled to and in signal communication with the memory 154. The one or more processors are configured to process data and may be implemented in hardware or software. For example, the processor 152 may be 8-bit, 16-bit, 32-bit, 64-bit or of any other suitable architecture. The processor 152 may include an arithmetic logic unit (ALU) for performing arithmetic and logic operations, processor registers that supply operands to the ALU and store the results of ALU operations, and a control unit that fetches instructions from memory 154 and executes them by directing the coordinated operations of the ALU, registers, and other components. The processor may include other hardware and software that operates to process information, control the systems 100, 200, and 300, and perform any of the functions described herein (e.g., with respect to FIGS. 1-3). The processor 152 is not limited to a single processing device and may encompass multiple processing devices.

The memory 154 comprises one or more disks, tape drives, or solid-state drives, and may be used as an over-flow data storage device, to store programs when such programs are selected for execution, and to store instructions and data that are read during program execution. The memory 154 may be volatile or non-volatile and may comprise ROM, RAM, ternary content-addressable memory (TCAM), dynamic random-access memory (DRAM), and static random-access memory (SRAM). The memory 154 is operable to store any suitable set of instructions 158, logic, rules, and/or code for executing the functions described in this disclosure with respect to FIGS. 1-3.

The I/O interface 156 is configured to communicate data and signals with other devices. For example, the I/O interface 156 may be configured to communicate electrical signals with the other components of the systems 100, 200, and 300. The I/O interface 156 may send signals that cause the compressor 120 to operate, cause a reversing valve (not shown for conciseness) to direct the flow of refrigerant through either a cooling or heating cycle, and adjust an open/closed state of controllable valve 202. The I/O interface 156 may use any suitable type communication protocol. The I/O interface 156 may comprise ports and/or terminals for establishing signal communications between the controller 150 and other devices. The I/O interface 156 may be configured to enable wired and/or wireless communications.

HVAC/Heat Pump System for Cooling Mode Charge Compensation

FIGS. 4-6 show example heat pump HVAC systems 400, 500, and 600 configured to provide improved operation via charge compensation in a heating mode. The systems 400, 500, and 600 include several components of the systems 100, 200, and 300 described above. Like systems 100, 200, and 300, the systems 400, 500, and 600 condition air for delivery to a conditioned space (e.g., all or a portion of a room, a house, an office building, a warehouse, or the like). In some embodiments, the systems 400, 500, and 600 are rooftop units (RTUs) that are positioned on the roof of a building, and the conditioned air is delivered to the interior of the building. In other embodiments, portion(s) of the systems 400, 500, and 600 may be located within the building and portion(s) outside the building. The systems 400, 500, and 600 may be configured as shown in FIGS. 4-6 or in any other suitable configuration.

In systems 400, 500, and 600, the first circuit 106*a* that is used for charge compensation is fluidly coupled to the liquid line 118 via an expansion-bypass line 402. As such refrigerant flowing to or from the first circuit 106*a* does not pass through expansion valve 116. Otherwise, refrigerant flows through the systems 400, 500, and 600 as described above with respect to FIGS. 1-3.

In the example system 400 of FIG. 4, a check valve 404 is positioned in the first manifold line 108*a* that couples the first circuit 106*a* to the manifold 102 (or the compressor 120). The check valve 404 prevents flow of refrigerant from the first circuit 106*a* to the manifold 102 (or the compressor 120) and allows flow of refrigerant from the manifold 102 (or compressor 120) to the first circuit 106*a*. When the system 100 is operating in a cooling mode, refrigerant flow is allowed from the compressor 120 to the first circuit 106*a*. During heating mode operation, refrigerant flow is prevented from first circuit 106*a* to the manifold 102 (or the compressor 120). This causes refrigerant to be stored in the first circuit 106*a* during heating mode operation and not contribute to the heating cycle. The configuration of system 400 with check valve 404 may be beneficial in circumstances in which the system 400 needs a higher cooling capacity than heating capacity (e.g., in warm climates). By storing refrigerant in the first circuit 106*a*, a decreased heating demand may be met more efficiently without requiring complex and costly charge compensation devices.

In the example system 500 of FIG. 5, the system 500 includes the check valve 404 positioned in manifold line 108*a* as well (see FIG. 4) as a controllable valve 502 positioned in the bypass line 402 connecting the first circuit 106*a* to the liquid line 118. Check valve 404 operates as described above with respect to the system 400 of FIG. 4 by preventing flow of refrigerant from the first circuit 106*a* to the manifold 102 (or the compressor 120) and allowing flow in the opposite direction. The first circuit 106*a* again stores refrigerant during heating mode operation. The controllable valve 502 can be used to adjust the amount of refrigerant stored in the first circuit 106*a* during heating mode operation. For example, the controllable valve 502 may close after a predetermined period of time of operating in the heating mode and/or after a predetermined volume of refrigerant is stored in the first circuit 106*a*. The configuration of system 500 with both the check valve 404 and a controllable valve 502 provides further control over the amount of refrigerant stored in the first circuit 106*a* during heating mode operation. System 500 may be used, for example, when the first heat exchange coil 104 is larger (or has a larger capacity) than the second heat exchange coil 122. This configuration may provide improved operation in the heating mode without complex and costly charge compensation devices.

In the example system 600 of FIG. 6, a check valve 602 is positioned in the bypass line 402 coupling the first circuit 106*a* to liquid line 118. The check valve 602 prevents flow of refrigerant from the liquid line 118 (or the second heat exchange coil 122) to the first circuit 106*a* and allows refrigerant flow in the opposite direction from the first circuit 106*a* to the liquid line 118 (or the second heat exchange coil 122). In this way, the check valve 602 prevents refrigerant from flowing through the first circuit 106*a* during heating mode operation. This configuration effectively decreases the number of circuits 106*a-c* that are used during heating mode operation. The configuration of system 600 may be used in circumstances of relative coil size and/or environmental conditions where less heating capacity than cooling capacity is needed.

The controller 150 is communicatively coupled (e.g., via wired and/or wireless connection) to components of the systems 400, 500, and 600 and configured to control their operation. The controller 150 generally controls operations of the compressor 120 and controllable valve 502. For example, instructions 158 stored in a memory 154 of the controller 150 may cause the controllable valve 502 to close and open, as described above. The processor 152 may include other hardware and software that operates to process information, control the systems 400, 500, and 600, and perform any of the functions described herein (e.g., with respect to FIGS. 4-6). The memory 154 is operable to store any suitable set of instructions 158, logic, rules, and/or code for executing the functions described in this disclosure with respect to FIGS. 4-6. The I/O interface 156 may send signals that adjust an open/closed state of controllable valve 502.

HVAC/Heat Pump System for Cooling Mode Charge Compensation

Figure 7:
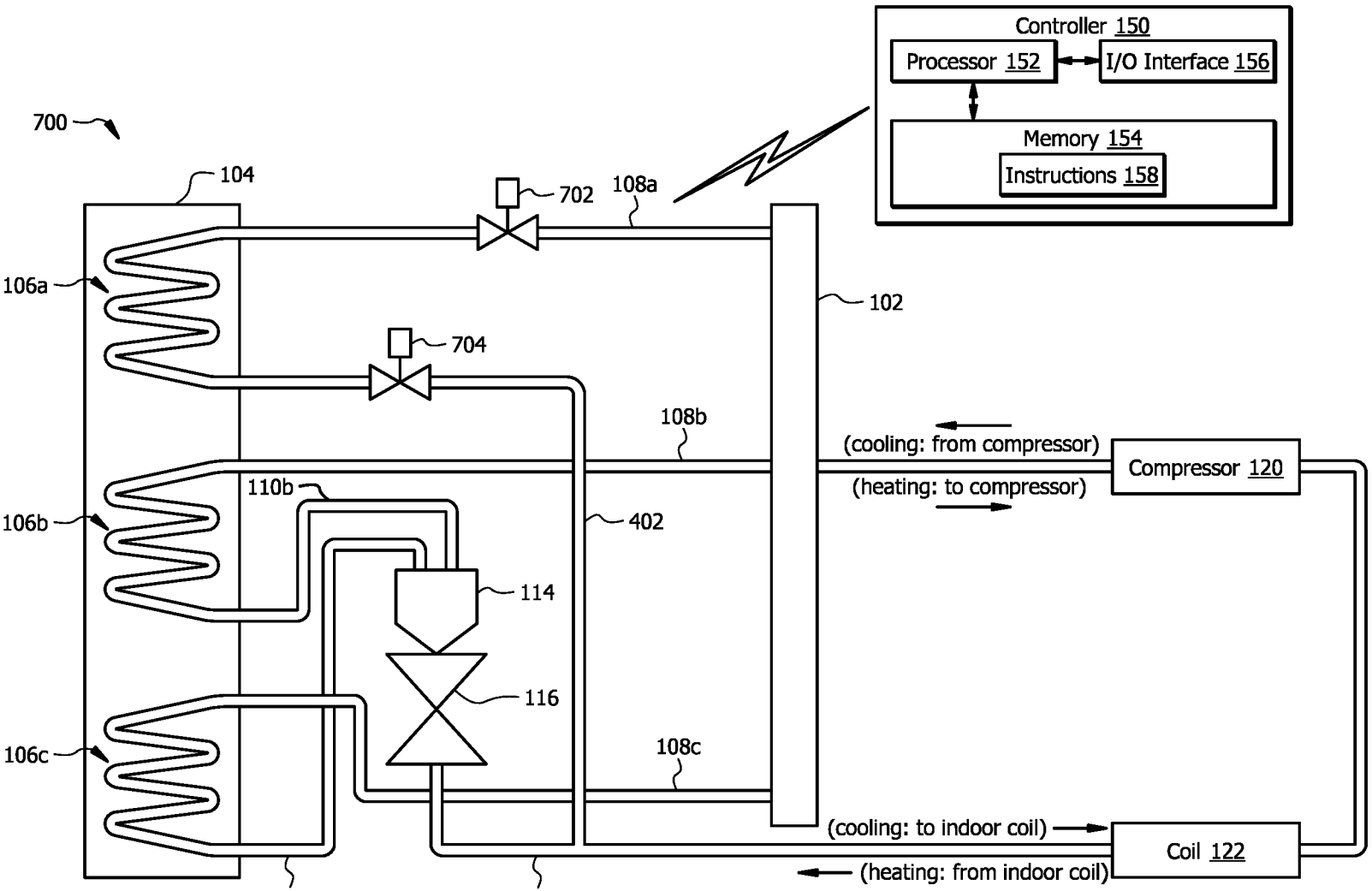
FIG. 7 is a diagram of an example heat pump system configured for improved operation during heating and cooling mode operation.

FIG. 7 shows an example heat pump HVAC system 700 configured to provide improved operation via charge compensation in a cooling mode and/or a heating mode. The system 700 includes several components of the systems 100, 200, 300, 400, 500, and 600, described above, including the bypass line 402 of FIGS. 4-6. Like systems 100, 200, 300, 400, 500, and 600, the system 700 conditions air for delivery to a conditioned space (e.g., all or a portion of a room, a house, an office building, a warehouse, or the like). In some embodiments, the system 700 is a rooftop unit (RTU) that is positioned on the roof of a building, and the conditioned air is delivered to the interior of the building. In other embodiments, portion(s) of the system 700 may be located within the building and portion(s) outside the building. The system 700 may be configured as shown in FIG. 7 or in any other suitable configuration.

The system 700 includes a first controllable valve 702 positioned in the manifold line 108*a* fluidly coupling the manifold 102 (or the compressor 120) to the first circuit 106*a* of the first heat exchange coil 104. The system 700 also includes a second controllable valve 704 positioned in the bypass line 402 fluidly coupling the first circuit 106*a* of the first heat exchange coil 104 to the liquid line 118 (or the second heat exchange coil 122). The first controllable valve 702 and second controllable valve 704 can be adjusted to achieve configurations similar to, or the same as, those shown in FIGS. 1-6 and described above to improve operations in heating mode or a cooling mode.

The TABLE below summarizes the positions of the first and second valves 702, 704 in different example operating conditions. In a normal cooling, both valves 702, 704 may be in an open position such that refrigerant flows through the first circuit 106*a* of the first heat exchange coil 104 and is not stored in the circuit 106*a*. If there is a relatively low demand for heating or cooling, both of the valves 702, 704 may be in a closed position such that refrigerant does not flow through the first circuit 106*a*. This effectively decreases the size of, or number of circuits 106*a-c* in, the first heat exchange coil 104.

TABLE

Example configuration of valves for various operating modes

| Valve | Normal cooling | Low cooling demand | Cooling charge compensation | Low heating demand | Heating charge compensation |
|---|---|---|---|---|---|
| Valve 702 | open | closed | open* | closed | closed |
| Valve 704 | open | closed | closed | closed | open* |

*Valves may be closed after a predetermined time and/or after a predetermined volume of refrigerant is stored in circuit 106a.

If charge compensation (e.g., temporary storage of some refrigerant) is needed during cooling mode operation, the second valve 704 is closed and the first valve 702 is open. The first valve 702 may be left open for the first circuit 106*a* to hold a maximum amount of refrigerant, or the first valve 702 may be closed after a predefined period of time and/or after a predetermined volume of refrigerant is stored in the first circuit 106*a*. Similarly, if charge compensation is needed during heating mode operation, the first valve 702 is closed and the second valve 704 is open. The second valve 704 may be left open for the first circuit 106*a* to hold a maximum amount of refrigerant, or the second valve 704 may be closed after a predefined period of time and/or after a predetermined volume of refrigerant is stored in the first circuit 106*a*.

The controller 150 is communicatively coupled (e.g., via wired and/or wireless connection) to components of the system 700 and configured to control their operation. The controller 150 generally controls operations of the compressor 120 and controllable valves 702 and 704. For example, instructions 158 stored in a memory 154 of the controller 150 may cause the controllable valves 702 and 704 to close and open, as described above. The processor may include other hardware and software that operates to process information, control the system 700, and perform any of the functions described herein (e.g., with respect to FIG. 7). The memory 154 is operable to store any suitable set of instructions 158, logic, rules, and/or code for executing the functions described in this disclosure with respect to FIG. 7. The I/O interface 156 may send signals that adjust an open/closed state of controllable valves 702 and 704.

Example Method of Operation

Figure 8:
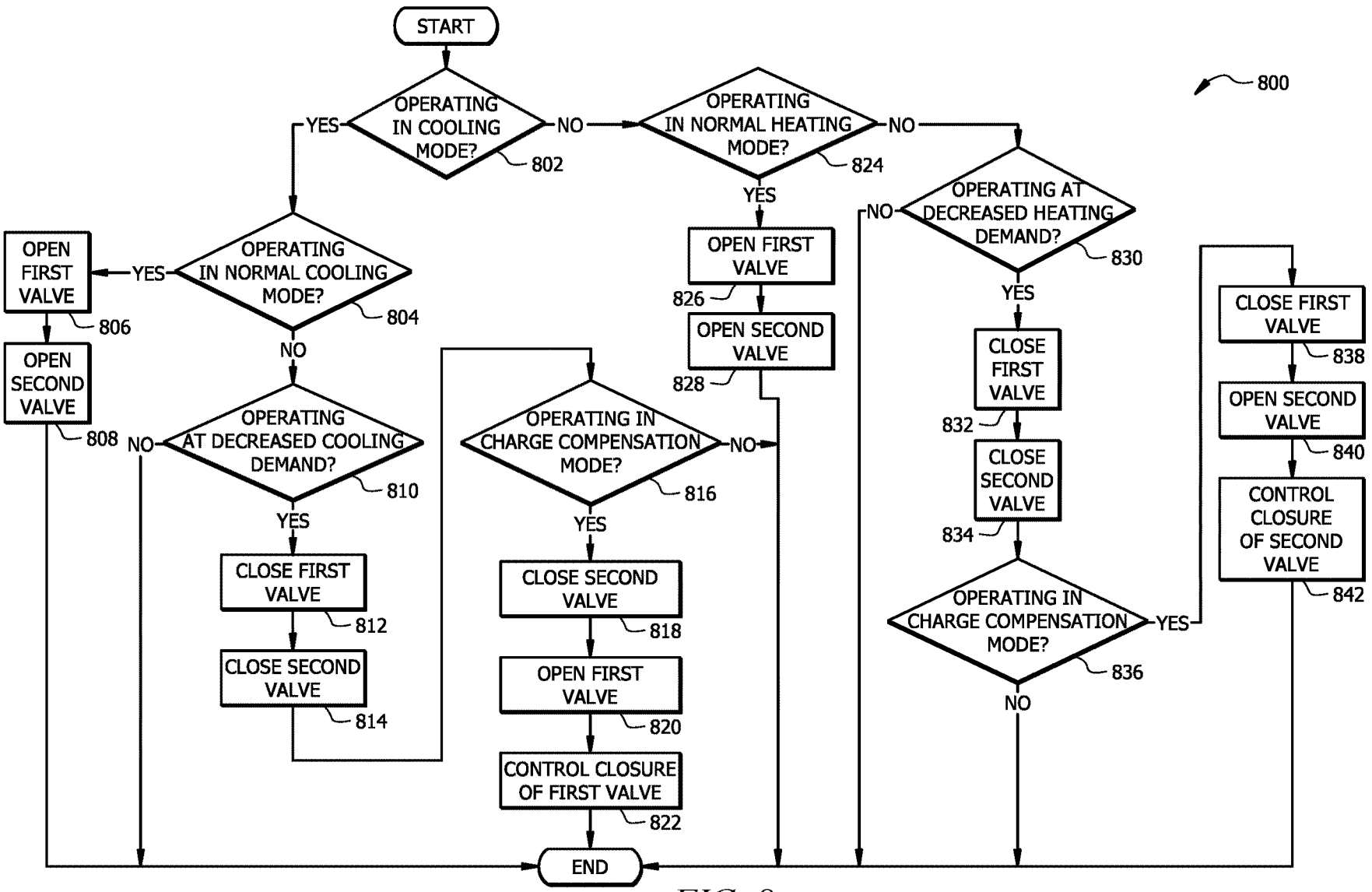
FIG. 8 is a flowchart of an example method of operating the systems of FIGS. 1-7.

FIG. 8 is a flowchart of an example method 800 of operating the systems of FIGS. 1-7. To provide an example, method 800 is described as being performed using the system 700 of FIG. 7. However, at least portions of the method 800 may be performed with other systems described in this disclosure (e.g., by adjusting controllable valves 202 and 502 of FIGS. 2 and 5). Operations of method 800 may be implemented using the processor 152, memory 154, and I/O interface 156 of the controller 150.

Method 800 may begin at operation 802 where the controller 150 determines whether the system 700 is (or should be) operating in a cooling mode. If this is the case, the controller 150 proceeds to operation 804. Otherwise, the controller 150 proceeds to operation 824 (described below). At operation 804, the controller 150 determines whether normal cooling mode operation is needed. For example, the controller 150 may determine whether the full capacity of the first heat exchange coil 104 is needed. If the full cooling capacity is needed, then the controller 150 determines that the normal cooling mode is needed. If normal cooling mode is needed at operation 804, the controller 150 proceeds to operation 806 where the first controllable valve 702 is opened (if not already open) and to operation 808 where the second controllable valve 704 is opened (if not already open). This configuration corresponds to that of the second column of the TABLE above.

If normal cooling mode is not needed at operation 804, the controller 150 proceeds to operation 810 and determines whether the system 700 is operating at a decreased cooling demand. If this is the case, the controller 150 proceeds to operation 812 where the first controllable valve 702 is closed (if not already closed) and to operation 814 where the second controllable valve 704 is closed (if not already closed). The method 800 may end after operating at decreased cooling demand. This configuration corresponds to that of the third column of the TABLE above.

At operation 816, the controller 150 determines whether the system 700 is operating in (or should be operating in) a charge compensation mode. For example, the controller 150 may determine whether a charge of refrigerant in the system 100 should be decreased during cooling mode operation. If this is the case, the controller 150 proceeds to operation 818. Otherwise, the method 800 ends. At operation 818, the controller closes the second valve 704 (if not already closed). At operation 820, the controller 150 opens the first valve 702 (if not already opened). Refrigerant then begins to be stored in the first circuit 106*a* of the first heat exchange coil 104. At operation 822, the controller 150 may cause the first valve 702 to close after a predetermined period of time and/or after a predetermined volume of refrigerant is stored in the first circuit 106*a*. This configuration corresponds to that of the fourth column of the TABLE above.

At operation 824, the controller 150 determines whether operating at a decreased heating demand is needed. If this is the case, the controller 150 proceeds to operation 826 where the first controllable valve 702 is closed (if not already closed) and to operation 828 where the second controllable valve 704 is closed (if not already closed). The method 800 may end after operating at a decreased heating demand. This configuration corresponds to that of the fifth column of the TABLE above.

At operation 830, the controller 150 determines whether the system 700 is operating in (or should be operating in) a charge compensation mode. For example, the controller 150 may determine whether a charge of refrigerant in the system 100 should be decreased during heating mode operation. If this is the case, at operation 832 the controller 150 closes the first valve 702 (if not already closed). If it is not the case, the method 800 may end. At operation 834, the controller 150 opens the second valve 704 (if not already opened). Refrigerant then begins to be stored in the first circuit 106*a* of the first heat exchange coil 104. At operation 836, the controller 150 may cause the second valve 704 to close after a predetermined period of time and/or after a predetermined volume of refrigerant is stored in the first circuit 106*a*. This configuration corresponds to that of the sixth column of the TABLE above.

Modifications, additions, or omissions may be made to method 800 depicted in FIG. 8. Method 800 may include more, fewer, or other operations. For example, operations may be performed in parallel or in any suitable order. While at times discussed as the controller 150 performing the operations, any suitable components (e.g., a thermostat) of the system 100 may perform one or more operations of the method 800.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A heating, ventilation, and air conditioning (HVAC) system configured to regulate a temperature of a space, the HVAC system comprising:
- a first heat exchange coil comprising a plurality of coil circuits;
- for each coil circuit of the plurality of circuits, a manifold line fluidly coupling the coil circuit to a compressor of the HVAC system;
- a first controllable valve positioned in a first manifold line coupling a first coil circuit of the plurality of coil circuits to the compressor;
- a second controllable valve located in a conduit fluidly coupling the first coil circuit to a second heat exchange coil; and
- a controller communicatively coupled to the first controllable valve and the second controllable valve, wherein the controller is configured to:
  - determine that the HVAC system is operating in a cooling mode;
  - determine that charge compensation is needed;
  - after determining that the HVAC system is operating in the cooling mode and that charge compensation is needed:
    - cause the first controllable valve to be in an open position for at least a period of time; and
    - cause the second controllable valve to be in a closed position, such that flow of refrigerant from the first coil circuit to the second heat exchange coil is prevented.

2. The HVAC system of claim 1, wherein the controller is further configured to cause the first controllable valve to close after a predetermined period of time of operating the HVAC system in the cooling mode.

3. The HVAC system of claim 1, wherein the controller is further configured to cause the first controllable valve to close after a predetermined volume of refrigerant is stored in the first coil circuit.

4. The HVAC system of claim 1, wherein the controller is further configured to:
- determine that the HVAC system is operating in a heating mode;
- determine that charge compensation is needed;
- after determining that the HVAC system is operating in the heating mode and that charge compensation is needed:
  - cause the second controllable valve to be in an open position; and
  - cause the first controllable valve to be in a closed position for at least a period of time, such that flow of refrigerant from the first coil circuit to the compressor is prevented.

5. The HVAC system of claim 4, wherein the controller is further configured to cause the second controllable valve to close after a predetermined period of time of operating the HVAC system in the heating mode.

6. The HVAC system of claim 4, wherein the controller is further configured to cause the second controllable valve to close after a predetermined volume of refrigerant is stored in the first coil circuit.

7. The HVAC system of claim 1, wherein the controller is further configured to:
- determine that the HVAC system is operating in a normal cooling mode;
- after determining that the HVAC system is operating in the normal cooling mode:
  - cause the first controllable valve to be in an open position; and
  - cause the second controllable valve to be in an open position.

8. The HVAC system of claim 1, wherein the controller is further configured to:
- determine that the HVAC system is operating in a low-demand cooling mode or a low- demand heating mode;
- after determining that the HVAC system is operating in the low-demand cooling mode or the low-demand heating mode:
  - cause the first controllable valve to be in a closed position; and
  - cause the second controllable valve to be in a closed position.

9. A method of operating a heating, ventilation, and air conditioning (HVAC) system, the method comprising:
- determining that the HVAC system is operating in a cooling mode;
- determine that charge compensation is needed;
- after determining that the HVAC system is operating in the cooling mode and that charge compensation is needed:
  - causing a first controllable valve to be in an open position for at least a period of time, wherein the first controllable valve is positioned in a first manifold line coupling a first coil circuit of a first heat exchange coil to a compressor; and causing a second controllable valve to be in a closed position, such that flow of refrigerant from the first coil circuit to a second heat exchange coil is prevented.

10. The method of claim 9, further comprising causing the first controllable valve to close after a predetermined period of time of operating the HVAC system in the cooling mode.

11. The method of claim 9, further comprising causing the first controllable valve to close after a predetermined volume of refrigerant is stored in the first coil circuit.

12. The method of claim 9, further comprising:

determining that the HVAC system is operating in a heating mode;

determining that charge compensation is needed;

after determining that the HVAC system is operating in the heating mode and that charge compensation is needed:

causing the second controllable valve to be in an open position; and causing the first controllable valve to be in a closed position for at least a period of time, such that flow of refrigerant from the first coil circuit to the compressor is prevented.

13. The method of claim 12, wherein further comprising causing the second controllable valve to close after a predetermined period of time of operating the HVAC system in the heating mode.

14. The method of claim 12, further comprising causing the second controllable valve to close after a predetermined volume of refrigerant is stored in the first coil circuit.

15. The method of claim 9, further comprising:

determining that the HVAC system is operating in a normal cooling mode;

after determining that the HVAC system is operating in the normal cooling mode:

causing the first controllable valve to be in an open position; and causing the second controllable valve to be in an open position.

16. The method of claim 9, further comprising:

determining that the HVAC system is operating in a low-demand cooling mode or a low-demand heating mode;

after determining that the HVAC system is operating in the low-demand cooling mode or the low-demand heating mode:

causing the first controllable valve to be in a closed position; and causing the second controllable valve to be in a closed position.

17. A controller of a heating, ventilation, and air conditioning (HVAC) system configured to regulate a temperature of a space, the controller comprising:

an interface communicatively coupled to:

a first controllable valve positioned in a first manifold line coupling a first coil circuit of a first heat exchange coil to a compressor;

a second controllable valve located in a conduit fluidly coupling the first coil circuit to a second heat exchange coil; and a processor communicatively coupled to the interface, wherein the processor is configure to:

determine that the HVAC system is operating in a cooling mode;

determine that charge compensation is needed;

after determining that the HVAC system is operating in the cooling mode and that charge compensation is needed:

cause the first controllable valve to be in an open position for at least a period of time; and cause the second controllable valve to be in a closed position, such that flow of refrigerant from the first coil circuit to the second heat exchange coil is prevented.

18. The controller of claim 17, wherein the processor is further configured to cause the first controllable valve to close after a predetermined period of time of operating the HVAC system in the cooling mode.

19. The controller of claim 17, wherein the processor is further configured to cause the first controllable valve to close after a predetermined volume of refrigerant is stored in the first coil circuit.

20. The controller of claim 17, wherein the processor is further configured to:

determine that the HVAC system is operating in a heating mode;

determine that charge compensation is needed;

after determining that the HVAC system is operating in the heating mode and that charge compensation is needed:

cause the second controllable valve to be in an open position; and cause the first controllable valve to be in a closed position for at least a period of time, such that flow of refrigerant from the first coil circuit to the compressor is prevented.

* * * * *